US010883339B2

(12) United States Patent
Shaker et al.

(10) Patent No.: US 10,883,339 B2
(45) Date of Patent: Jan. 5, 2021

(54) EQUALIZING HYDROCARBON RESERVOIR PRESSURE

(71) Applicant: Saudi Arabian Oil Company, Dhahran (SA)

(72) Inventors: Wisam Shaker, Al-Khobar (SA); Faisal Al-Naseef, Al-Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 251 days.

(21) Appl. No.: 16/025,559

(22) Filed: Jul. 2, 2018

(65) Prior Publication Data

US 2020/0003027 A1 Jan. 2, 2020

(51) Int. Cl.

| | |
|---|---|
| ***G06G 7/48*** | (2006.01) |
| ***E21B 41/00*** | (2006.01) |
| ***E21B 43/16*** | (2006.01) |

(52) U.S. Cl.

CPC ..... *E21B 41/0092* (2013.01); *E21B 43/164* (2013.01); *E21B 43/168* (2013.01)

(58) Field of Classification Search

CPC ... E21B 41/0092; E21B 43/164; E21B 13/168
USPC ..... 703/9, 10
See application file for complete search history.

(56) References Cited

U.S. PATENT DOCUMENTS

2011/0290479 A1* 12/2011 Izgec ..... E21B 43/16 166/250.02
2014/0190691 A1* 7/2014 Vinegar ..... E21B 43/2401 166/272.1
2016/0024893 A1* 1/2016 Al-Zawawi ..... G06F 30/20 703/10

OTHER PUBLICATIONS

Algdamsi et al., "Field Scale Injection Efficiency Optimization Based on Combined Analysis of Finite Difference and Streamline Simulation: Case Study," SPE-171926, presented at the Abu Dhabi International Petroleum Exhibition and Conference, Nov. 10-13, 2014, 12 pages.
Saripally, "CO2 Flood Optimisation Using Streamlines—A Case Study," SPE-172810, presented at SPE Middle East Oil and Gas Show and Conference, Mar. 8-11, 2015, 13 pages.
Nagib et al., "Application of Streamline Simulation for Gas Displacement Processes," SPE-169703, presented at the SPE EOR Conference at Oil and Gas West Asia, Mar. 31-Apr. 2, 2014, 11 pages.
Hoier et al, "Miscible gas injection in undersaturated gas-oil systems," SPE 90379, SPE Ann. Techn. and Exhib. Houston TX, pp. 1-15, Jan. 2004, 15 pages.

(Continued)

*Primary Examiner* — Andre Pierre Louis
(74) *Attorney, Agent, or Firm* — Fish & Richardson P.C.

(57) ABSTRACT

A hydrocarbon reservoir model simulation is executed to distribute gas among available gas injectors associated with a hydrocarbon reservoir. Using the result of the executed hydrocarbon reservoir simulation, streamline tracing is executed to calculate hydrocarbon flow fields. Using the results of the executed hydrocarbon reservoir simulation and the executed streamline tracing, a reservoir pressure equalization (RPE) algorithm is executed to distribute an amount of gas according to an injection strategy to satisfy an assigned voidage replace ratio (VRR) for each region of the hydrocarbon reservoir. Post-processing of the results of the RPE algorithm is performed. Using the result of the post-processing, gas injection in the hydrocarbon reservoir is performed with the available gas injectors.

20 Claims, 10 Drawing Sheets

(56) References Cited

OTHER PUBLICATIONS

PCT International Search Report and Written Opinion in International Appln. No. PCT/US2019/039788, dated Oct. 7, 2019, 12 pages.
GCC Examination Report in GCC Appln. No. GC 2019-37866, dated Jun. 29, 2020, 4 pages.

* cited by examiner

EQUALIZING HYDROCARBON RESERVOIR PRESSURE

BACKGROUND

Enhanced oil recovery (EOR), often referred to as tertiary recovery, includes techniques (for example, gas injection, chemical injection, and thermal recovery) for increasing an amount of hydrocarbons (for example, crude oil) extracted from a hydrocarbon reservoir field. Gas injection, which uses miscible gases, such as nitrogen, carbon dioxide ($CO_2$), or natural gas, is the most common EOR approach. In gas injection, one or more miscible gases are introduced into a hydrocarbon reservoir to maintain hydrocarbon reservoir pressure and improve hydrocarbon displacement.

SUMMARY

The present disclosure describes equalization of hydrocarbon reservoir pressure.

In an implementation, a hydrocarbon reservoir model simulation is executed to distribute gas among available gas injectors associated with a hydrocarbon reservoir. Using the result of the executed hydrocarbon reservoir simulation, streamline tracing is executed to calculate hydrocarbon flow fields. Using the results of the executed hydrocarbon reservoir simulation and the executed streamline tracing, a reservoir pressure equalization (RPE) algorithm is executed to distribute an amount of gas according to an injection strategy to satisfy an assigned voidage replace ratio (VRR) for each region of the hydrocarbon reservoir. Post-processing of the results of the RPE algorithm is performed. Using the result of the post-processing, gas injection in the hydrocarbon reservoir is performed with the available gas injectors.

Implementations of the described subject matter, including the previously described implementation, can be implemented using a computer-implemented method; a non-transitory, computer-readable medium storing computer-readable instructions to perform the computer-implemented method; and a computer-implemented system comprising one or more computer memory devices interoperably coupled with one or more computers and having tangible, non-transitory, machine-readable media storing instructions that, when executed by the one or more computers, perform the computer-implemented method/the computer-readable instructions stored on the non-transitory, computer-readable medium.

The subject matter described in this specification can be implemented in particular implementations, so as to realize one or more of the following advantages. First, current streamline simulation packages available in the oil and gas market can be used only for slightly-compressible injected fluids. However, the described approach can account for an injection of gases into a hydrocarbon reservoir. Second, unlike current streamline simulation packages, the described approach, can handle an equation-of-state approach. For example, the DESTINY streamline-based multipurpose utility, by the Model Calibration and Efficient Reservoir Imaging (MCERI) group at Texas A&M University, College Station, Tex., USA) is used to trace streamlines from gas injectors towards surrounding producers using outcomes of a hydrocarbon reservoir simulation run. The outcomes of the streamline and hydrocarbon reservoir simulation are used in a hydrocarbon reservoir pressure equalizer (RPE) approach to distribute an amount of injected gas among active gas injectors to achieve an assigned voidage replace ratio (VRR) for each region of the hydrocarbon reservoir and reduce a pressure difference between an average reservoir pressure for the entire hydrocarbon reservoir and a hydrocarbon reservoir pressure per region. Third, the described approach can be employed by coupling a streamline utility capable of handling compressible fluids (for example, DESTINY) with a commercial Finite Difference Simulator (for example, the ECLIPSE reservoir simulator, by Schlumberger Technology Corporation, Sugar Land, Tex., USA). Fourth, the described approach avoids over pressurization of particular areas of a hydrocarbon reservoir by closing gas injectors and redirecting gas into hydrocarbon reservoir low-pressure areas. High-pressure areas (that is, above an original hydrocarbon reservoir pressure) can be reduced over time due to closing of more than one gas injector. The approach permits an increase in overall hydrocarbon reservoir field pressure and a higher level of hydrocarbon recovery. Long-term optimization of gas injection can help to maintain the enhanced hydrocarbon recovery. Additionally, some inactive hydrocarbon producers in hydrocarbon reservoir low-pressure areas (LPAs) can be returned to production when the described approach allocates more gas to the LPAs. Fifth, the described approach ensures that gas injection efficiency per gas injector remains higher than 25% during a hydrocarbon reservoir field's life cycle. A gentle decline in hydrocarbon reservoir field pressure has been observed with the described approach, in spite of raising hydrocarbon reservoir field production rates by 25%. Sixth, the described approach permits determination of advantageous gas injector locations in a hydrocarbon reservoir field. A gas injection strategy can be developed using the determined gas injection locations to enhance hydrocarbon production in low-pressure areas (LPAs) of the hydrocarbon reservoir.

The details of one or more implementations of the subject matter of this specification are set forth in the Detailed Description, the Claims, and the accompanying drawings. Other features, aspects, and advantages of the subject matter will become apparent to those of ordinary skill in the art from the Detailed Description, the Claims, and the accompanying drawings.

DESCRIPTION OF DRAWINGS

Like reference numbers and designations in the various drawings indicate like elements.

DETAILED DESCRIPTION

Figure 1:
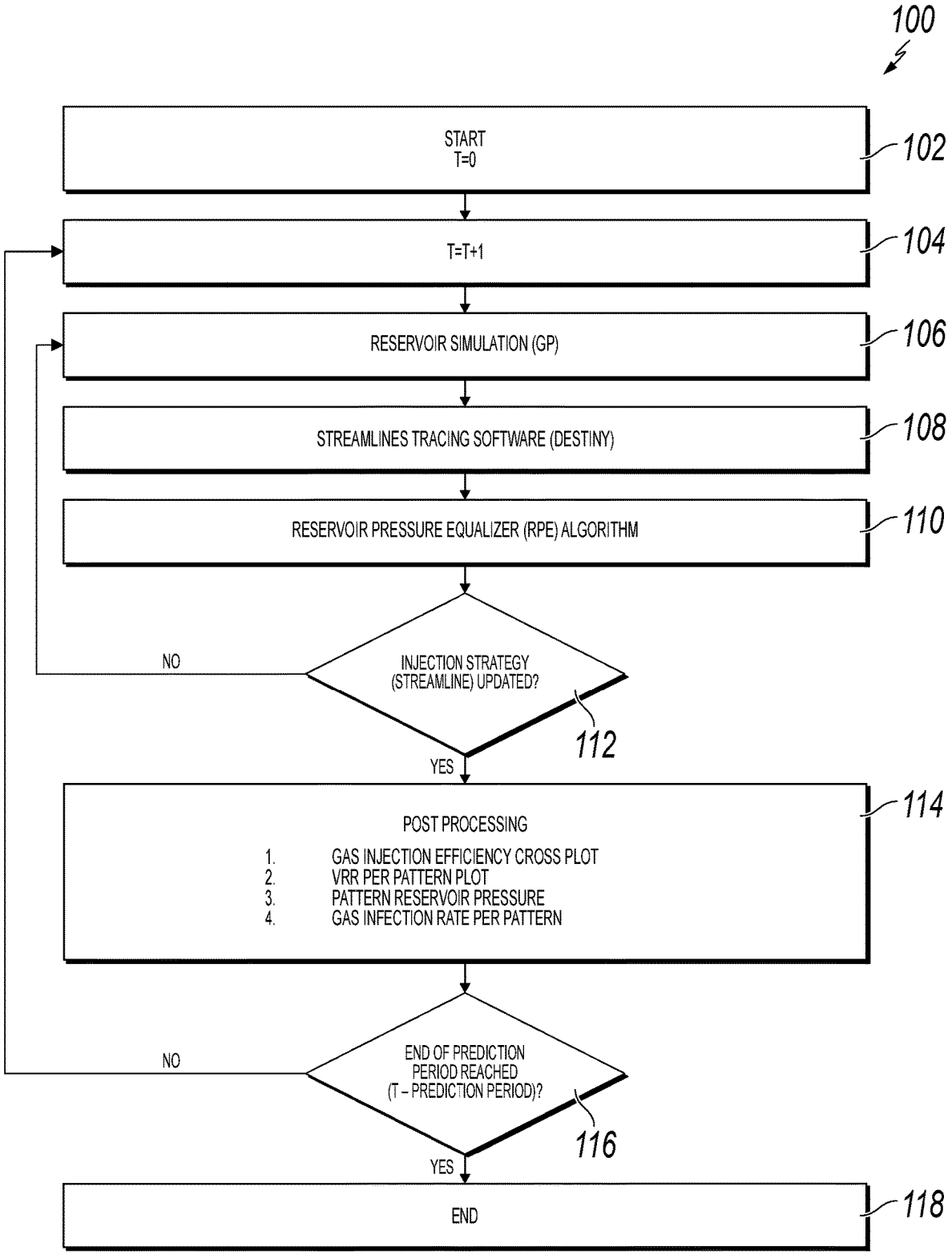
FIG. 1 is a flow chart illustrating an example of a high-level computer-implemented method for equalization of hydrocarbon reservoir pressure, according to an implementation of the present disclosure.

The following detailed description describes equalization of hydrocarbon reservoir pressure, and is presented to enable any person skilled in the art to make and use the disclosed subject matter in the context of one or more particular implementations. Various modifications, alterations, and permutations of the disclosed implementations can be made and will be readily apparent to those of ordinary skill in the art, and the general principles defined can be applied to other implementations and applications, without departing from the scope of the present disclosure. In some instances, one or more technical details that are unnecessary to obtain an understanding of the described subject matter and that are within the skill of one of ordinary skill in the art may be omitted so as to not obscure one or more described implementations. The present disclosure is not intended to be limited to the described or illustrated implementations, but to be accorded the widest scope consistent with the described principles and features.

Enhanced oil recovery (EOR), often referred to as tertiary recovery, includes techniques (for example, gas injection, chemical injection, and thermal recovery) for increasing an amount of hydrocarbons (for example, crude oil) extracted from a hydrocarbon reservoir field. Gas injection, which uses miscible gases, such as nitrogen, carbon dioxide ($CO_2$), or natural gas, is the most common EOR approach. In gas injection, one or more miscible gases are introduced into a hydrocarbon reservoir to maintain hydrocarbon reservoir pressure and improve hydrocarbon displacement. The miscible gas(es) cause reduction of an interfacial tension between oil and water to be reduced (removing the interface between the two interacting fluids) and permits substantially complete displacement efficiency.

Conventional streamline simulation packages available in the oil and gas market can be used only for slightly-compressible injected fluids. Streamline simulation provides an alternative to cell-based grid techniques in hydrocarbon reservoir simulation, and represents a snapshot of an instantaneous hydrocarbon flow field. Streamlines produce data including drainage/irrigation regions associated with producing/injecting wells and a flow rate allocation between injector/producer pairs. Evaluation of the efficiency of injectors and producers using streamlines is typically more efficient than cell-based simulation techniques. Simulation of displacement of resident oil by gas at high-pressures is concerned with simulation of local sweep efficiency and channeling. Streamlines are designed to model this type of data without incurring numerical difficulties associated with other modeling techniques. For example, it is possible to divide a hydrocarbon reservoir into dynamically defined drainage zones attached to wells. Properties normally associated with hydrocarbon reservoir volumes can be expressed on a per-well basis, such as oil-in-place, water-in-place, and average pressure.

Described is an approach to, at a high-level, equalize hydrocarbon reservoir pressure (that is, balancing a pressure profile) throughout a hydrocarbon reservoir at each successive stage of hydrocarbon reservoir depletion and to achieve an assigned instantaneous voidage replace ratio (VRR) for each region. Unlike conventional streamline methods, the described approach can handle an equation-of-state approach and account for an injection of gases into a hydrocarbon reservoir. The described approach can be used as part of a software tool to enable evaluation of an injection history and for management of future gas injection processes.

Included in the described approach is a hydrocarbon reservoir simulation, software to trace streamline tracing, and a determination of a distribution of injected gas among gas injectors. For example, the DESTINY streamline-based multipurpose utility, by the Model Calibration and Efficient Reservoir Imaging (MCERI) group at Texas A&M University, College Station, Tex., USA) is used to trace streamlines from gas injectors towards surrounding producers using outcomes of a hydrocarbon reservoir simulation run. The outcomes of the streamline and hydrocarbon reservoir simulation are used in a hydrocarbon reservoir pressure equalizer (RPE) algorithm to distribute an amount of injected gas among active gas injectors to achieve an assigned VRR for each region of the hydrocarbon reservoir and to reduce a pressure difference between an average reservoir pressure for the entire hydrocarbon reservoir and a hydrocarbon reservoir pressure per region. In some implementations, the described approach is employed by coupling a streamline utility capable of handling compressible fluids (for example, DESTINY) with a commercial Finite Difference Simulator (for example, the ECLIPSE reservoir simulator, by Schlumberger Technology Corporation, Sugar Land, Tex., USA).

The RPE algorithm is configured to equalize hydrocarbon reservoir pressure throughout the hydrocarbon reservoir where gas injectors are in a gas cap. Produced gas is reinjected into the gas cap (that is, gas recycling) to maintain reservoir pressure of the gas cap. Resource management division concerns are where, when and how much gas volume should be injected into gas injectors to equalize the pressure profile to achieve the VRR per region of the hydrocarbon reservoir.

In some implementations, redistributing injected gas among active gas injectors is based on: 1) the value of VRR assigned for each region (the area which is formed by producers receiving more than 5% of gas injected in from a specific injector; 2) identification of a difference between region pressure and an average reservoir pressure; 3) and a determination of how much gas is necessary for injection to compress a gas cap region (gas that accumulates in an upper portions of a hydrocarbon reservoir) to provide energy for oil recovery due to subsequent expansion of the compressed gas cap.

Over pressurization of particular areas of a hydrocarbon reservoir is avoided by closing gas injectors and redirecting gas into hydrocarbon reservoir low-pressure areas. High-pressure areas (that is, areas of pressure above an original hydrocarbon reservoir pressure) can be reduced over time due to closing of more than one gas injector. An increase in overall hydrocarbon reservoir field pressure and a higher level of hydrocarbon recovery can be realized. Long-term optimization of gas injection can help to maintain the enhanced hydrocarbon recovery. The approach can allow inactive hydrocarbon producers in hydrocarbon reservoir low-pressure areas (LPAs) to be returned to production when the approach allocates more gas to the LPAs.

The described approach can ensure that gas injection efficiency per gas injector remains higher than 25% during a hydrocarbon reservoir field's life cycle. A gentle decline in hydrocarbon reservoir field pressure has been observed with the described approach, even though hydrocarbon reservoir field production rates were raised by 25%.

The described approach also permits determination of advantageous gas injector locations in a hydrocarbon reservoir field. Using this determination, a gas injection strategy can be developed to enhance production in LPAs.

FIG. 1 is a flow chart illustrating an example of a high-level computer-implemented method 100 for equalization of hydrocarbon reservoir pressure, according to an implementation of the present disclosure. For clarity of presentation, the description that follows generally describes method 100 in the context of the other figures in this description. However, it will be understood that method 100 can be performed, for example, by any system, environment, software, and hardware, or a combination of systems, environments, software, and hardware, as appropriate. In some implementations, various steps of method 100 can be run in parallel, in combination, in loops, or in any order.

At a high-level and in some implementations, the method described in FIG. 1 combines a hydrocarbon reservoir simulation, streamline tracing software (for example, DESTINY) and the previously described RPE to optimize a gas injection rate on a per injector basis on a monthly basis. A summary of an implementation of method 100 includes:

1) Begin a run of a reference case (that is, a do-nothing scenario) for a defined simulation period. In some implementations, the defined simulation period can be defined by a user or dynamically determined by an algorithm using data associated with the described approach. For example, the reference case can be run for a total defined simulation period of three months. In some instances, the decision as to the length of the simulation period can be made based how streamline geometry changes with time (for example, when new gas injectors are added or some hydrocarbon producers or gas injectors are closed for a period of time). The reference case begins with a hydrocarbon reservoir prediction using hydrocarbon reservoir modeling software (for example, GIGAPOWERS, by Saudi Aramco, Dhahran, Saudi Arabia) with a streamline option enabled for streamline data or executing a separate streamline tracing software package (for example, the previously-described DESTINY) using the results of the hydrocarbon reservoir modeling software.
2) Collect data (for example, refer to FIG. 2) as input for the previously described RPE algorithm,
3) Execute the RPE algorithm using the collected data to calculate a gas injection rate,
4) Run the reference case in prediction until the end of the defined simulation period using the calculated gas injection rate for each injector, and
5) Return to 2) to perform a gas injection optimization for a successive time step. The approach is continued until the end of a prediction period to determine a reasonable pressure balance for the hydrocarbon reservoir.

In particular:

At 102, the processing run of method 100 is started at a time (T) equal to 0. For the processing run, a prediction period is selected. For example, the prediction period can be defined as 10 years. Additionally, an increment period is also defined. For example, increments of 3 months can be defined (that is, the overall processing run would consider 120 months given a 10 year prediction period). From 102, method 100 proceeds to 104.

At 104, the time value is incremented by 1 increment period (for example, to indicate a three month simulation execution). From 104, method 100 proceeds to 106.

At 106, a hydrocarbon reservoir model simulation is executed for the defined simulation period using a hydrocarbon reservoir simulator (for example GIGAPOWERS). Note that in the first run, the execution will complete a reference case that equally distributes gas injection among available gas injectors because no results have been returned from an execution of the RPE (refer to 110). From 106, method 100 proceeds to 108.

At 108, the results of the hydrocarbon reservoir simulation is used in a streamline tracing software utility (for example, DESTINY) to calculate streamline data pertaining to the hydrocarbon reservoir simulation data. The streamline tracing software utility calculates connectivity between each available gas injector and surrounding hydrocarbon producers, how much gas is injected toward each hydrocarbon producer, and how much fluid is produced from each hydrocarbon producer due to gas injection from a specific available gas injector. From 108, method 100 proceeds to 110.

Figure 2:
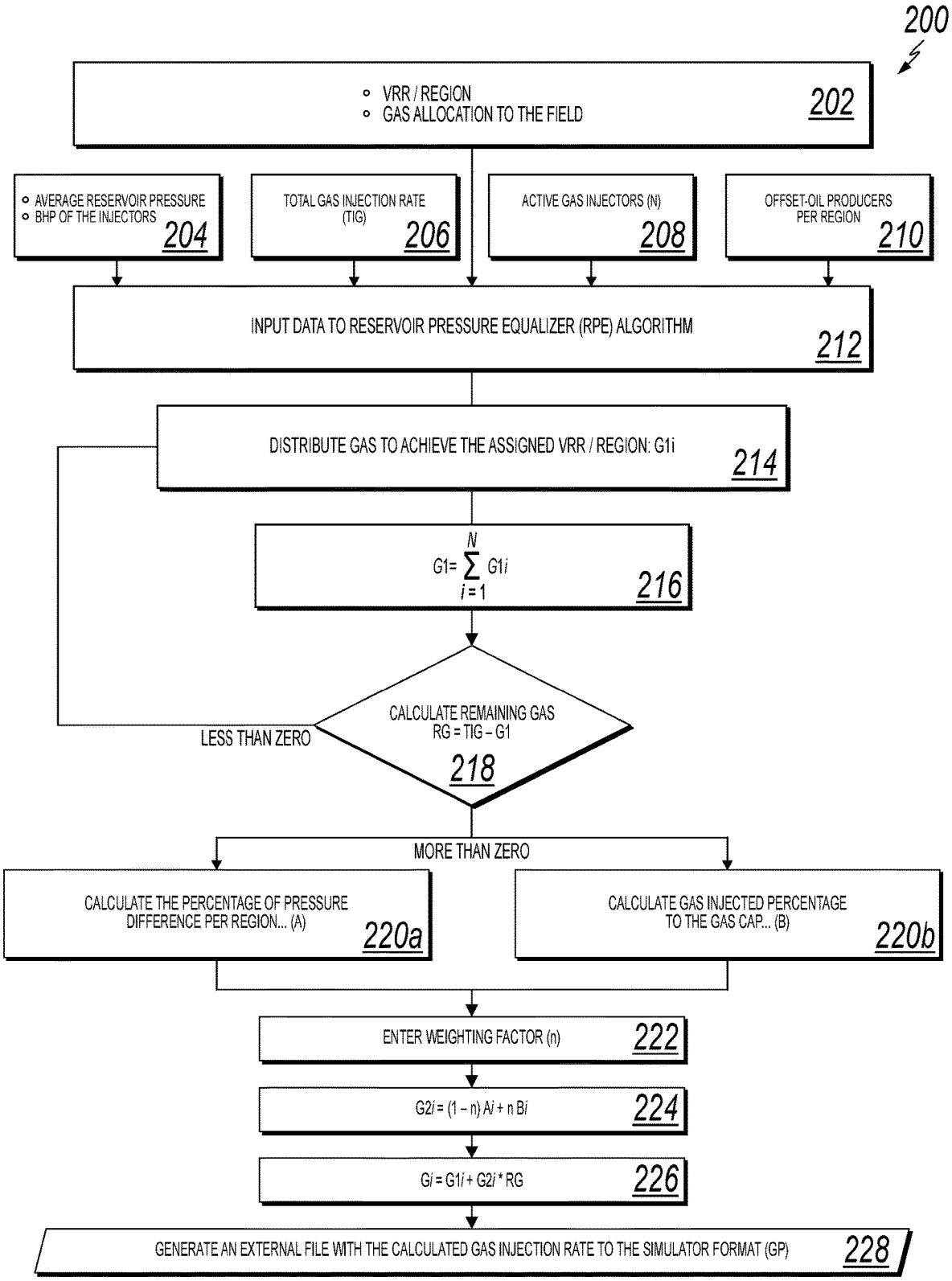
FIG. 2 is a flowchart illustrating an example of a computer-implemented method for hydrocarbon reservoir pressure equalization, according to an implementation of the present disclosure.

At 110, the data from the hydrocarbon reservoir simulation and the streamline tracing software is passed to the RPE algorithm, as described in FIG. 2.

Turning to FIG. 2, FIG. 2 is a flowchart illustrating an example of a computer-implemented method 200 for hydrocarbon RPE, according to an implementation of the present disclosure. For clarity of presentation, the description that follows generally describes method 200 in the context of the other figures in this description. However, it will be understood that method 200 can be performed, for example, by any system, environment, software, and hardware, or a combination of systems, environments, software, and hardware, as appropriate. In some implementations, various steps of method 200 can be run in parallel, in combination, in loops, or in any order.

At a high-level, the RPE algorithm distributes gas injection amounts according to an injection strategy to satisfy an assigned VRR for each region. Here, the total gas injection, active gas injectors and the total fluids production per region are used. The computed amount of the injected gas for the hydrocarbon reservoir field (G1). In a second stage, an amount of remaining gas (RG) in million standard cubic feet per day (MMscf/D) to inject is distributed among the injectors based on the following factors:

1) A difference between the region pressure and average reservoir pressure of the entire hydrocarbon reservoir, and
2) How much gas to inject is allocated to compress the gas cap per region.

Here, the compression amount is an output from DESTINY.

An absolute difference between the hydrocarbon reservoir region pressure and the average reservoir pressure (RS) in pounds per square inch (psi) is calculated for each region. The differences are converted into a percentage value (A) for each region. The algorithm also calculates a percentage of gas to inject (B) to compress the gas cap, if any. The remaining gas to inject (G2) is distributed to injectors, using Equation (1):

$$G2i=((1-n)*Ai)+n*Bi \quad (1),$$

where i a region index (as used in Equation (2)) and n is a weighting value (for example, ranging from 0 to 1). If n has a value of 0, a value of 1 is assigned to A and B is ignored. G2i is calculated based on how far the reservoir pressure in a particular region deviates from the average reservoir pressure; used for equalization of the reservoir pressure. If n=1, G2i=Bi (not preferred case). The value of n can be used strategically. For example, if an engineer would like to add a portion of the gas to compress a gas cap specifically for a new gas injector, at the beginning, the gas is used to compress the gas cap based on streamline analysis outcomes. After a period of time, connectivity starts to be established with surrounding producers. For mature gas injectors, very little gas is used to compress the gas cap. In this case, there is no need to allocate a value for B. In some implementations, several scenarios may need to be executed with different values of n to select which value of n provides a determined best gas injection strategy. For example, referring to FIG. 5B, a narrower range 506*b* when compared to 506*a* is desired.

A total gas injection per region amount is then calculated, using Equation (2):

$$Gi=G1i+G2i*RG \quad (2),$$

where i is a region index number.

In typical implementations, method 200 distributes gas so that the VRR for each region equals 0.9-1.0 (for example, assigned by hydrocarbon reservoir engineers; where 0.9-1.0 is preferable from reservoir engineering point-of-view). Then the RPE distributes the remaining gas (that is, total available gas−total gas distributed early) among active gas injectors. An active gas injector means that the particular gas injector is under a gas injection process and open (ON), while an inactive gas injector means that the particular gas injector is closed (OFF).

At 212, data is input to the RPE algorithm. In some implementations, input data is collected from the RSim and SL outcome files and stored in an external data store (for example, a spreadsheet) for optimum gas injection rate calculations and includes:

- 202: 1) VRR per Region (a ratio (source: streamline (SL) outcomes)) and 2) Gas allocation to the field in MMscf/D (source: hydrocarbon reservoir simulation (RSim) outcomes)),
- 204: 1) RS and 2) Bottom Hole Pressure (BHP) of the injectors (source: RSim) psi,
- 206: Total Gas Injection Rate (TIG) MMscf/D (source: RSim),
- 208: Active Gas Injectors (N) (count (source: RSim)), and
- 210: Offset-Oil Producers per Region (count (source: SL)).

From 212, method 200 proceeds to 214.

At 214, gas is distributed to achieve an assigned VRR/Region: G1i. In 214:

a) Specify VRR per region; for mature injector: VRR=0.9-1, for new injectors VRR=1.1-2, and b) Calculate the gas injection rates for each regions G1i; i refer to region index number using: VRRi=G1i/(total fluid production of the offset wells)i.

From 214, method 200 proceeds to 216.

At 216, the total gas injection rate is calculated (G1 MMscf/D). From 216, method 200 proceeds to 218.

At 218, a determination is made with respect to the remaining gas (TIG−G1). If it is determined that the remaining gas is less than 0 MMscf/D, method 200 returns back to 214. If, however, it is determined that the remaining gas is more than 0, method 200 proceeds to 220*a* and 220*b*. At 218, subtract the available gas injection rate (TIG) in the field from the calculated gas injection rates (G1) in step 216 (RG MMscf/D), if it is:

a) Negative: proceed to 214; reduce the assigned VRRi per region, or b) Positive: proceed to 220*a*/220*b*.

At 220*a*, the percentage of pressure difference per region is calculated with respect to the average reservoir pressure RS:

a) The average reservoir pressure per region is calculated, and b) The computed values (from step a) are subtracted from the hydrocarbon reservoir field pressure and the difference converted to a percentage (Ai: %).

From 220*a*, method 200 proceeds to 222.

At 220*b*, Total needed gas to inject to compresses the gas cap is calculated and converted to a percentage (Bi: %). From 220*b*, method 200 proceeds to 222.

At 222, a weighting value (n) is entered. From 222, method 200 proceeds to 224.

At 224, the remaining gas to be distributed to the injectors is calculated using Equation (1). That is, the allocated amount of gas for each region is calculated from the total remaining amount of gas to be injected (G2i:%). From 224, method 200 proceeds to 226.

At 226, a total amount of gas to be injected is calculated using Equation (2). That is, a total gas injection rate for each region (Gi MMscf/D) is calculated. From 226, method 200 proceeds to 228.

At 228, an external file is generated containing the calculated gas injection rate per injector as an input file suitable for the hydrocarbon reservoir simulator used (for example, GIGAPOWERS). After 228, method 200 stops and the process returns to FIG. 1 at 110. After 110, method 100 proceeds to 112.

At 112, a determination is made whether the injection strategy has been updated. The calculated gas injection rates at a period X are used as input for a next period X+1. Optimum gas injections rates are computed using RPE. The simulation run is then updated with the recently calculated optimum gas injection rates. If the injection strategy has not been updated, method 100 proceeds back to 106 where the external data store is used again for hydrocarbon reservoir simulation. If it is determined that the injection strategy has been updated, method 100 proceeds to 114.

At 114, post processing of the received data is performed. In some implementations a: 1) a gas injection efficiency cross plot; 2) VRR per region plot; 3) average reservoir pressure per region plot; and 4) gas injection rate per region plot is generated. From 114, method 100 proceeds to 116.

At 116, a determination is made whether the end of the prediction period has been reached. If the end of the prediction period has not been reached, method 100 proceeds back to 104. If it is determined that the end of the prediction period has been reached, method 100 proceeds to 118.

At 118, in some implementations, additional post-processing or other operations can be performed using generated output data. For example, in some implementations, generated output data from method 100, method 200, or a combination of both can be used with a computer-controlled system to dynamically control one or more gas injectors in a hydrocarbon reservoir. After 118, method 100 stops.

The proposed workflow described in FIGS. 1 and 2 has been tested on a carbonate hydrocarbon reservoir producing under the expansion of a gas cap and a weak bottom water drive. Associated gas production was reinjected into several gas injectors distributed throughout the gas cap to support hydrocarbon reservoir pressure and enhance oil production. Two plans in prediction were used to evaluate the impact of the gas redistribution injection rates on the hydrocarbon reservoir pressure per region, the computed VRR, and the efficiency of the gas injectors.

Figure 3:
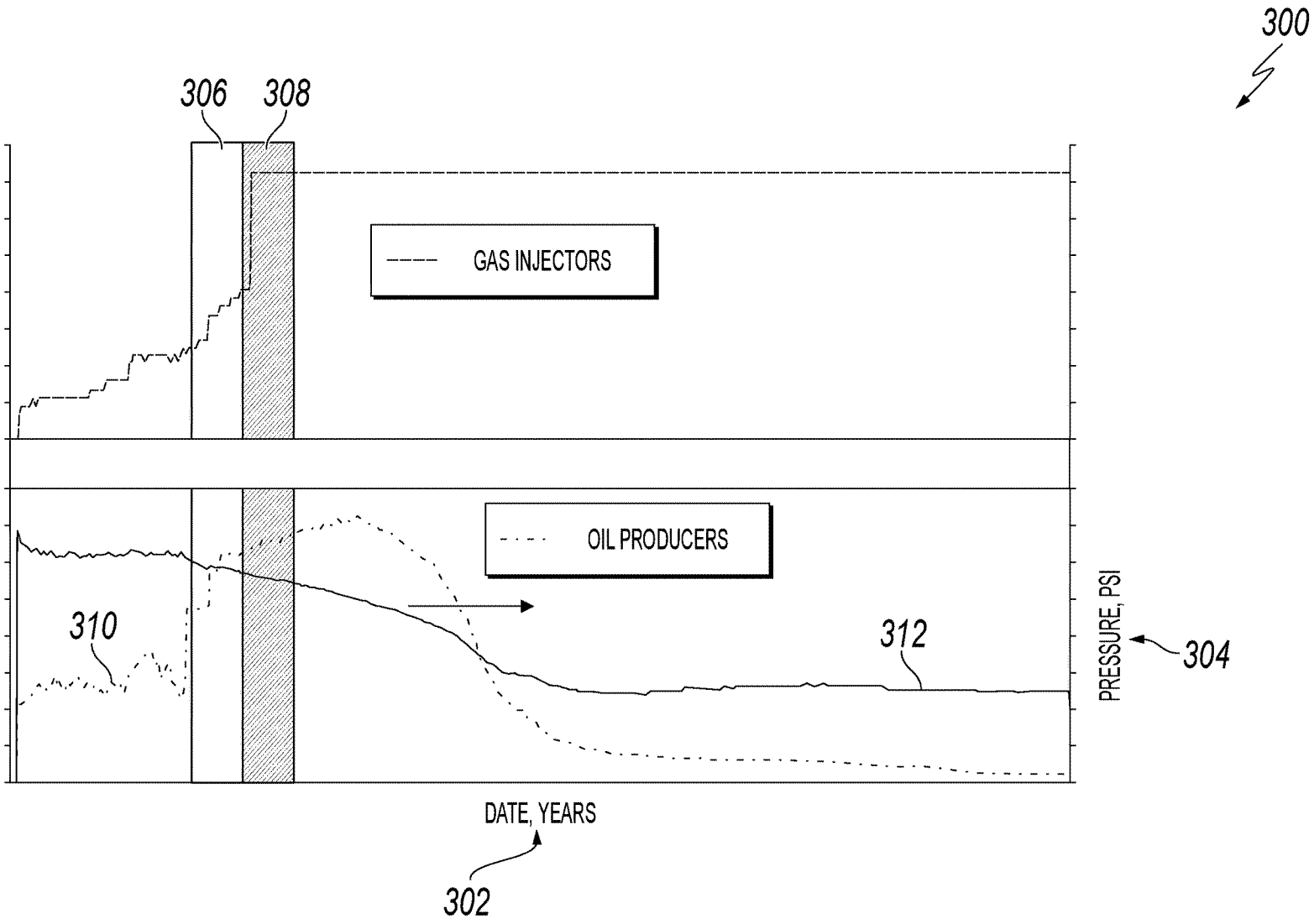
FIG. 3 is a graph illustrating an example of active gas injectors and oil producers, according to an implementation of the present disclosure.

Referring to FIG. 3, FIG. 3 is a graph 300 illustrating an example of active gas injectors and oil producers, according to an implementation of the present disclosure. The graph 300 has an X-axis 302 of date in years and a Y-axis 304 of pressure in psi. Two plans 306 and 308 have a duration of five years each.

In plan 1 306, a number (for example, x) of new gas injectors were added to the field associated with the hydrocarbon reservoir. In plan 2 308, a number (for example, xx) of new Gas Injectors were added. As can be seen by line 310, several new Oil Producers were added in both periods for plan 1 306 and plan 2 308. Curve 312 represents the average reservoir pressure. The streamline geometries and gas injection rates were updated with an increment period of three months. For more accurate controlling of the hydrocarbon reservoir pressure, the gas injection strategy can be updated every month and once new gas injectors are added to the injection process. For a quick evaluation of the proposed workflow, a large update increment period (for example, three months) can be used.

As previously mentioned, FIG. 3 shows the count of oil producers and gas injectors during the plan 1 306 and the plan 2 308. Several runs with different values of n were conducted. As illustrated, the best results were reached when the weighting value (n) has a value of 0.2. As previously mentioned, a narrow range is desired. After several runs were carried out to see the impact of the 0.2 value on the area average hydrocarbon reservoir pressure portfolio, FIG. 5B, 506*b* illustrates a narrow result when compared to 506*a* in FIG. 5A (do nothing scenario). Therefore, 20% can be considered to be the weighting value for the gas injected to compress the gas cap term (B—see FIGS. 2, 220*b*) and 80% to the hydrocarbon reservoir pressure difference term (A—see FIG. 2, 220*a*).

Figure 4:
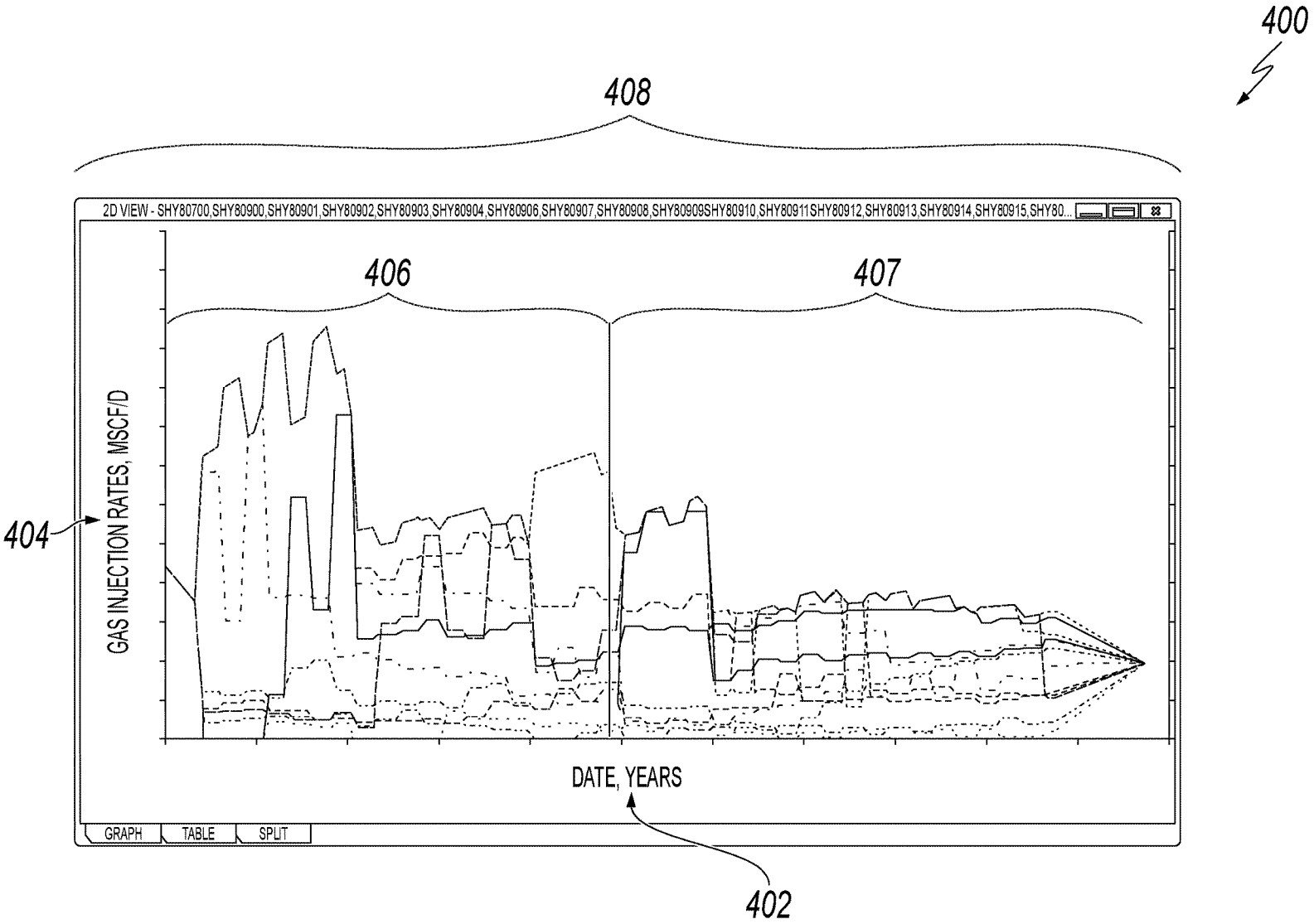
FIG. 4 is a graph illustrating an example of computed gas injection rates, according to an implementation of the present disclosure.

Turning to FIG. 4, FIG. 4 is a graph 400 illustrating an example of computed gas injection rates, according to an implementation of the present disclosure. The graph 400 has an X-axis 402 of date in years and a Y-axis 404 of gas injection rate in thousand standard cubic feet per day (Mscf/D). Calculated gas injection rates for the injectors (of FIG. 3) are shown for 10 years in prediction. FIG. 4 illustrates a hydrocarbon reservoir management gas injection strategy of adding new injectors within a first 5 year plan 406 and a second 5 year plan 407, as opposed to continuously adding new producers within 10 years 408 and to what extent this strategy impacts hydrocarbon reservoir pressure 304, as demonstrated by the curve 312 in FIG. 3, through an optimization period.

Figure 5A:
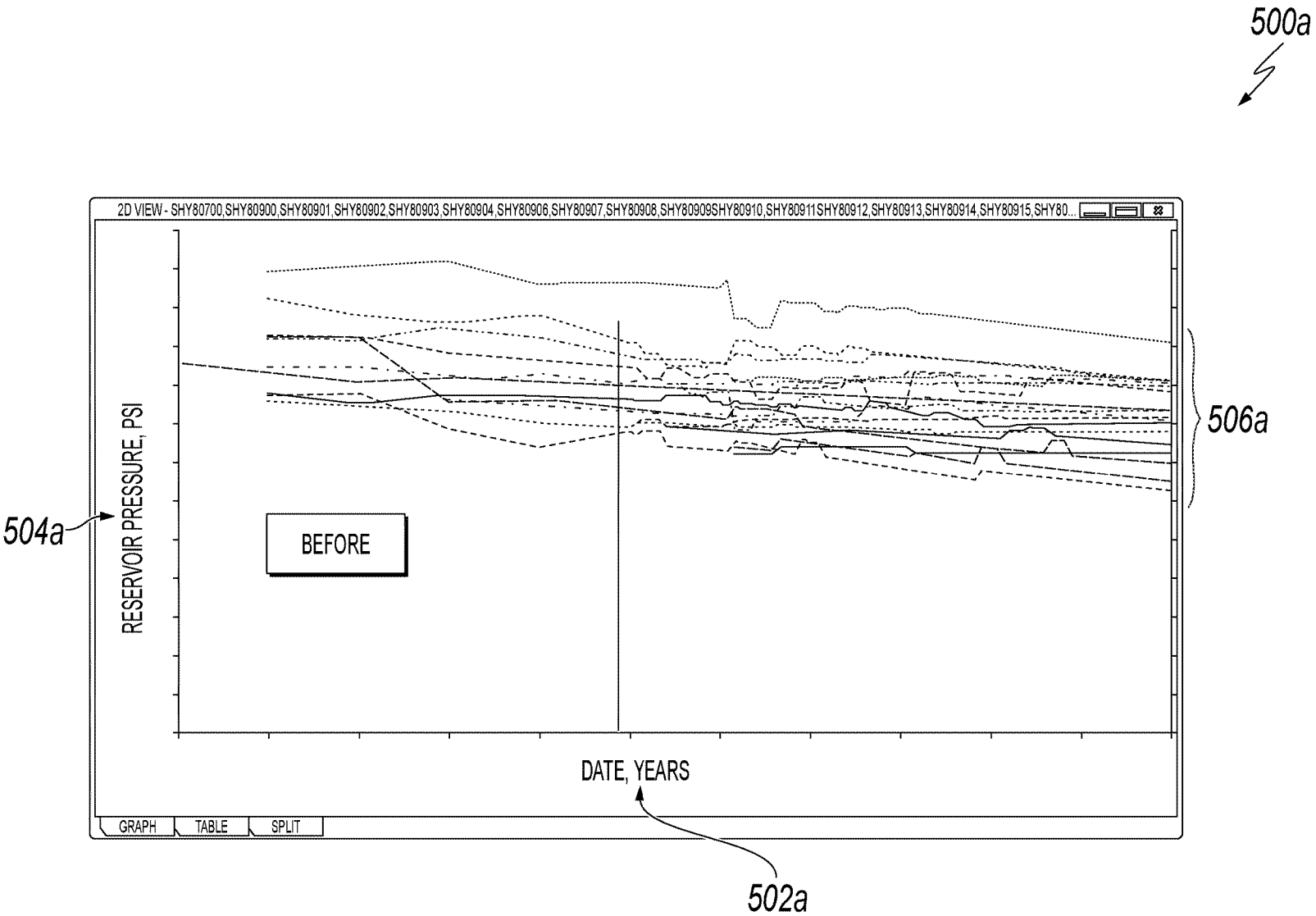
FIGS. 5A and 5B are graphs illustrating an example of a computer average reservoir pressure/region before and after the described optimization process, according to an implementation of the present disclosure.
Figure 5B:
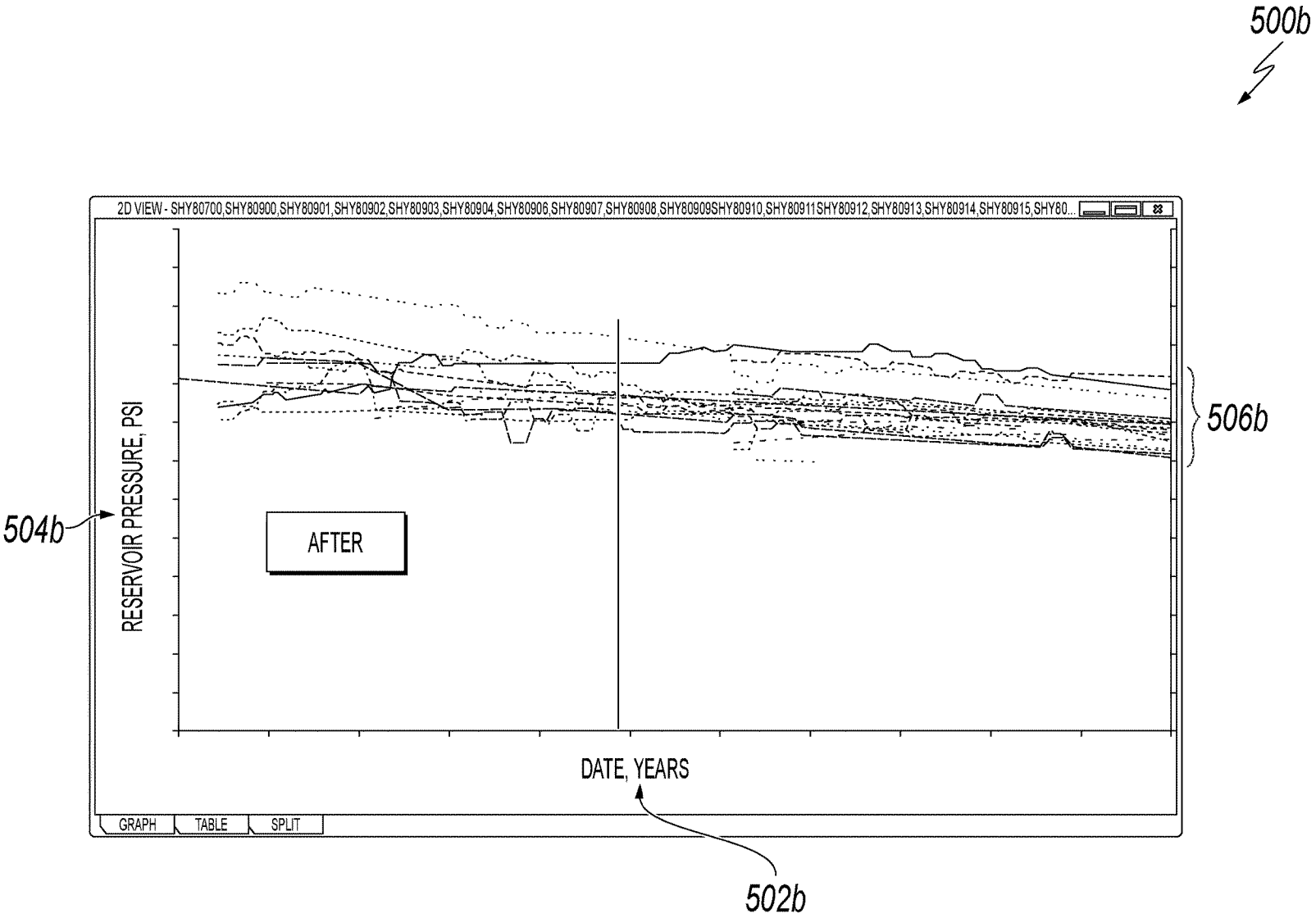

Turning to FIGS. 5A and 5B, FIGS. 5A and 5B are graphs 500*a* and 500*b*, respectively, illustrating an example of a computer average reservoir pressure/region before and after, respectively, the described optimization process in FIGS. 1 and 2, according to an implementation of the present disclosure. The graph 500*a* has an X-axis 502*a* of date in years and a Y-axis 504*a* of reservoir pressure in psi. The graph 500*b* has an X-axis 502*b* of Date in years and a Y-axis 504*b* of Reservoir Pressure in psi) The pressure profile for each region through the optimization period is shown in FIGS. 5A and 5B. The pressure difference range before the optimization is 501 psi at 506*a*. A significant reduction in pressure difference range of 60% was gained when the gas injection rate is redistributed among the gas injectors. The described approach succeeded in reducing the hydrocarbon reservoir pressure in the high pressure regions and increase the hydrocarbon reservoir pressure in the low pressure regions to values close to the average reservoir pressure (at 506*b*) for the entire hydrocarbon reservoir within an acceptable range (for example, +/−150 psi).

Figure 6:
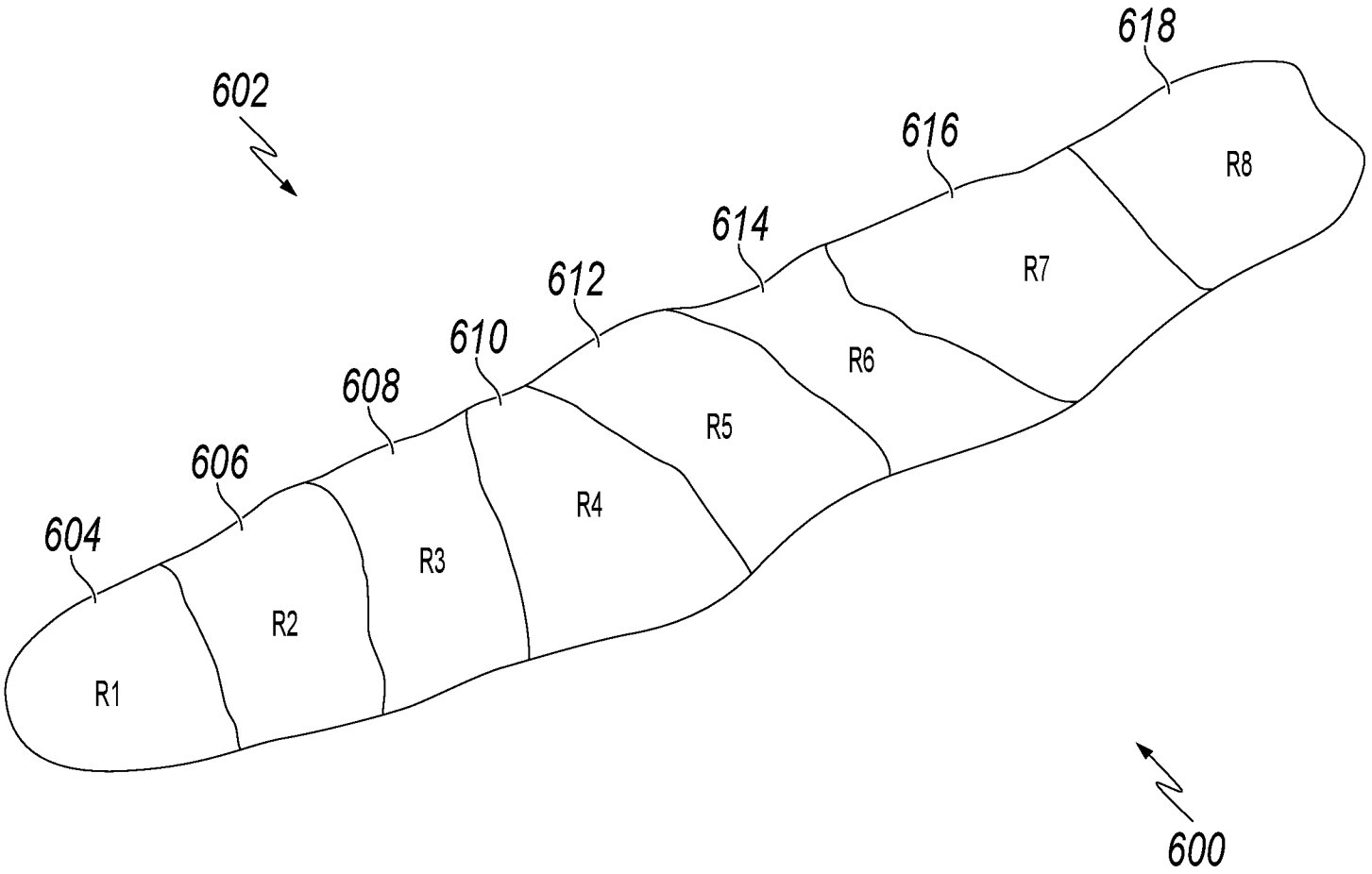
FIG. 6 is a diagram illustrating an example map of streamline outcomes that identified eight regions in a hydrocarbon reservoir, according to an implementation of the present disclosure.

Turning to FIG. 6, FIG. 6 is a diagram 600 illustrating an example map of streamline outcomes that identified eight regions in a hydrocarbon reservoir, according to an implementation of the present disclosure. As illustrated, diagram 600 shows a hydrocarbon reservoir 602 and eight regions R1-R8 (604-618). In FIG. 6, the illustrated area of each of the eight regions R1-R8 (604-618) is directly proportional to an amount of gas injected into the gas injectors for each region.

Figure 7:
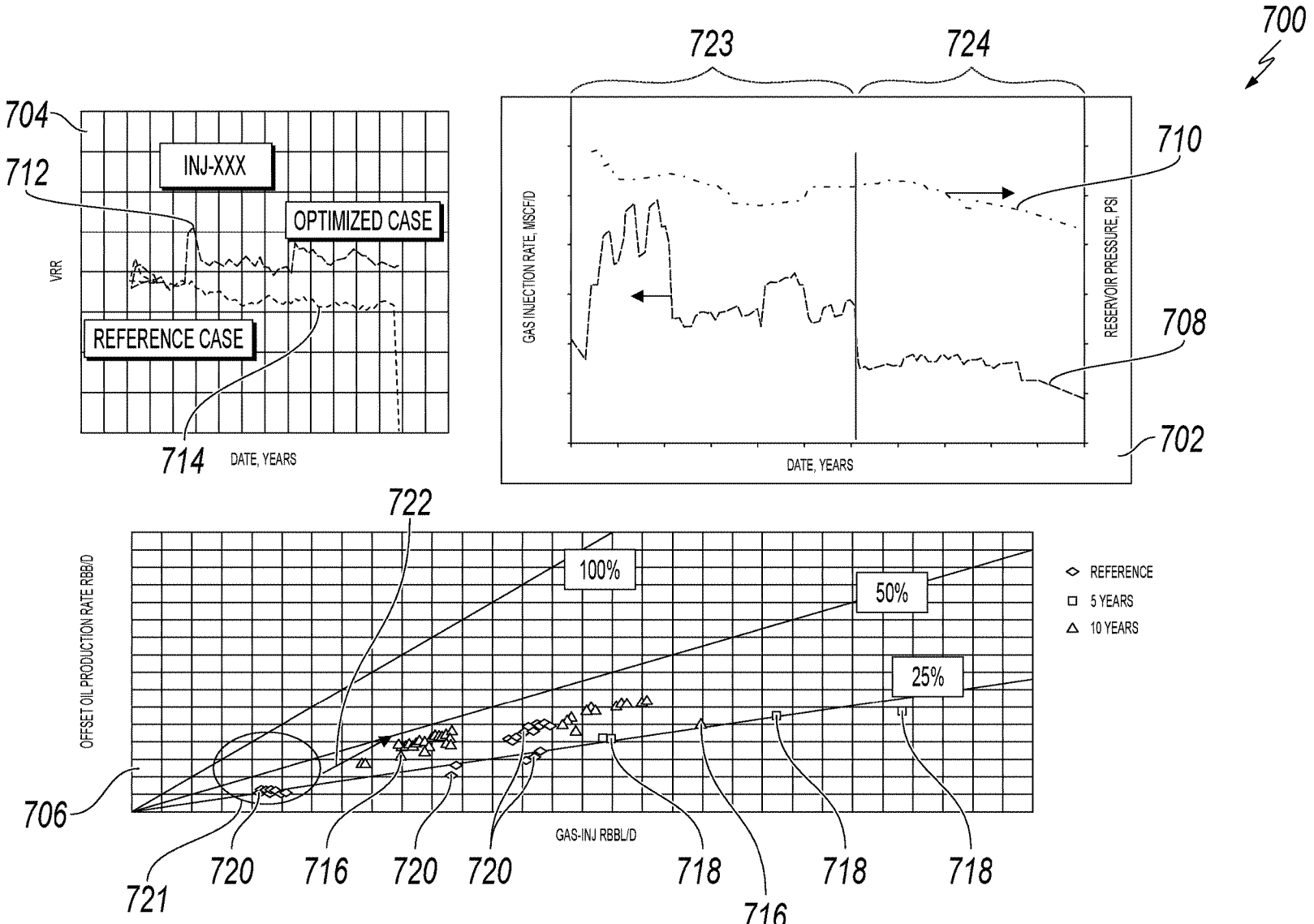
FIG. 7 illustrates an example of a gas injection management plot, according to an implementation of the present disclosure.

Turning to FIG. 7, FIG. 7 illustrates an example of a gas injection management plot 700, according to an implementation of the present disclosure. The plot 700 includes three sub-plots 702, 704, and 706 combined together into plot 700, and illustrates that the described approach succeeded to increase gas injection efficiency of the injectors. In some implementations, plot 700 can be generated by a spreadsheet, such as EXCEL.

The top right plot 702 demonstrates optimum gas injection rates for an injector A (curve 708) and the average reservoir pressure for the region (curve 710). The top left plot 704 demonstrates a VRR for an optimized case 712 that represents both optimized case plan 1 and case plan 2 in comparison with reference case 714 (that is, a do nothing scenario). The bottom plot 706 demonstrates an improvement in gas injection efficiency for injector A (triangles 716 (optimized case plan 2) and squares 718 (optimized case plan 1)) in comparison with the reference case 714 (diamonds 720). Circle 721 demonstrates improvement of gas injector efficiencies from a 25% efficiency base run (represented by diamonds 720 within circle 721) and following the arrow 722 attached to circle 721 towards triangles 716 on an approximate 45% line (not illustrated), which represents an optimized case plan 2.

In the top right plot 702, time period 723 represents optimized case plan 1 and time period 724 represents optimized case plan 2. 708 and 710 (in time period 723 and 724) represent, respectively, the Reservoir Pressure 710 and Gas injection rate 708 within the period of optimization (that is, optimized case plan 1+optimized case plan 2). Reservoir pressure 710 is represented in psi and gas injection rate 708 in Mscf/D.

Figure 8:
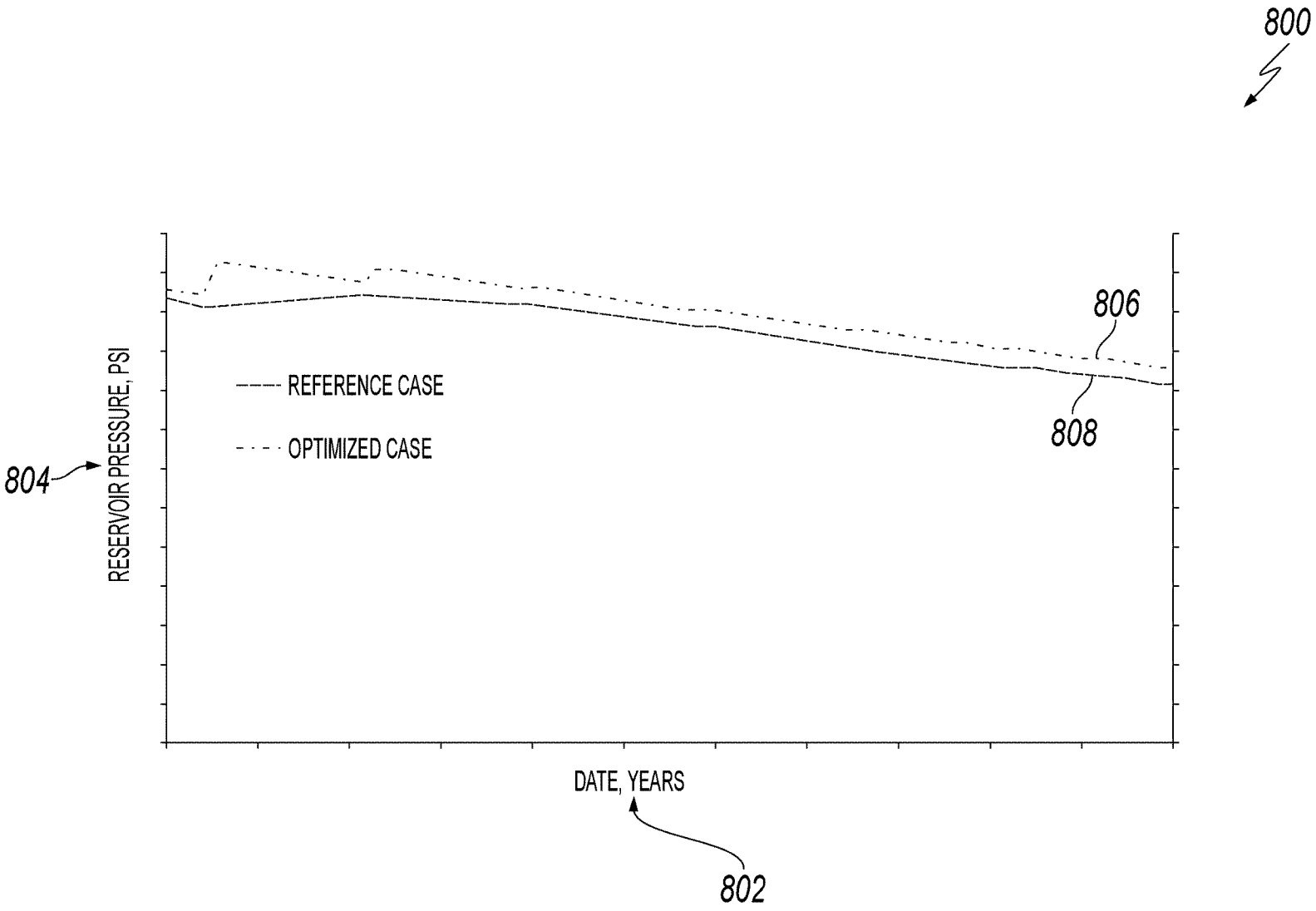
FIG. 8 is a graph illustrating an example of hydrocarbon reservoir pressure before and after gas injection optimization, according to an implementation of the present disclosure.

Turning to FIG. 8, FIG. 8 is a graph 800 illustrating an example of hydrocarbon reservoir pressure before and after gas injection optimization, according to an implementation of the present disclosure. The graph 800 has an X-axis of Date (years) 802 and a Y-axis of pressure (psi) 804. FIG. 8 shows that the described approach of FIGS. 1 and 2 succeeded to increase the average reservoir pressure in the range of 15 to 30 psi within the 10 years in prediction for identical fluids produced. As can be seen, optimized case 806 has a higher average pressure range than the reference case 808.

Figure 9:
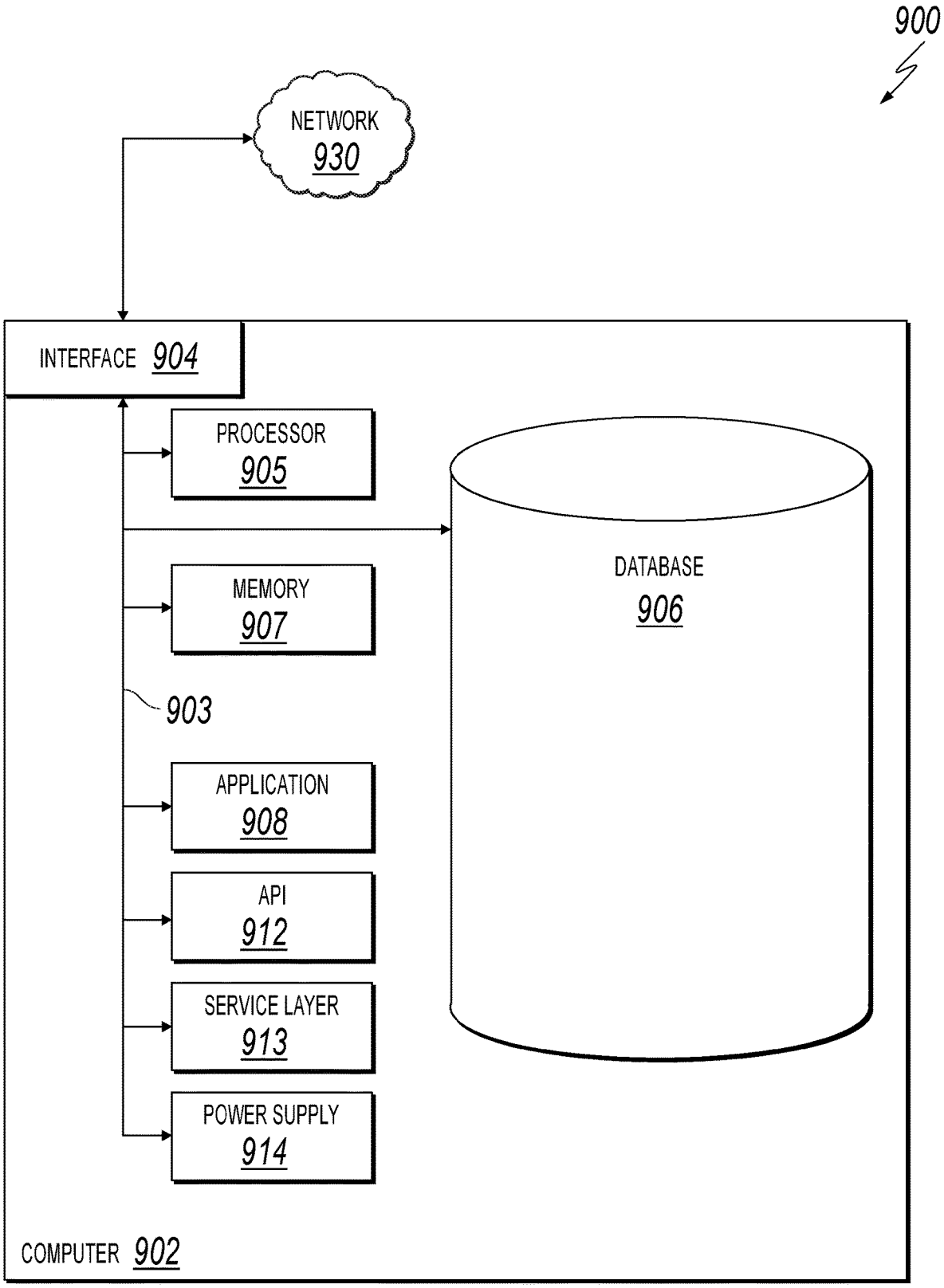
FIG. 9 is a block diagram illustrating an example of a computer-implemented system used to provide computational functionalities associated with described algorithms, methods, functions, processes, flows, and procedures, according to an implementation of the present disclosure.

FIG. 9 is a block diagram illustrating an example of a computer-implemented System 900 used to provide computational functionalities associated with described algorithms, methods, functions, processes, flows, and procedures, according to an implementation of the present disclosure. In the illustrated implementation, System 900 includes a Computer 902 and a Network 930.

The illustrated Computer 902 is intended to encompass any computing device such as a server, desktop computer, laptop/notebook computer, wireless data port, smart phone, personal data assistant (PDA), tablet computer, one or more processors within these devices, another computing device, or a combination of computing devices, including physical or virtual instances of the computing device, or a combination of physical or virtual instances of the computing device. Additionally, the Computer 902 can include an input device, such as a keypad, keyboard, touch screen, another input device, or a combination of input devices that can accept user information, and an output device that conveys information associated with the operation of the Computer 902, including digital data, visual, audio, another type of information, or a combination of types of information, on a graphical-type user interface (UI) (or GUI) or other UI. For example, in some implementations, the illustrated graphs/plots (such as, FIGS. 3-4, 5A-5B, and 6-8) or other GUIs (not illustrated) that are associated with the illustrated graphs/plots can be interactive in nature and permit user actions to be performed (such as, triggering messages or requests for data to change, modify, or enhance the data plots or to perform actions based on the displayed data).

The Computer 902 can serve in a role in a distributed computing system as a client, network component, a server, a database or another persistency, another role, or a combination of roles for performing the subject matter described in the present disclosure. The illustrated Computer 902 is communicably coupled with a Network 930. In some implementations, one or more components of the Computer 902 can be configured to operate within an environment, including cloud-computing-based, local, global, another environment, or a combination of environments.

At a high level, the Computer 902 is an electronic computing device operable to receive, transmit, process, store, or manage data and information associated with the described subject matter. According to some implementations, the Computer 902 can also include or be communicably coupled with a server, including an application server, e-mail server, web server, caching server, streaming data server, another server, or a combination of servers.

The Computer 902 can receive requests over Network 930 (for example, from a client software application executing on another Computer 902) and respond to the received requests by processing the received requests using a software application or a combination of software applications. In addition, requests can also be sent to the Computer 902 from internal users (for example, from a command console or by another internal access method), external or third-parties, or other entities, individuals, systems, or computers.

Each of the components of the Computer 902 can communicate using a System Bus 903. In some implementations, any or all of the components of the Computer 902, including hardware, software, or a combination of hardware and software, can interface over the System Bus 903 using an application programming interface (API) 912, a Service Layer 913, or a combination of the API 912 and Service Layer 913. The API 912 can include specifications for routines, data structures, and object classes. The API 912 can be either computer-language independent or dependent and refer to a complete interface, a single function, or even a set of APIs. The Service Layer 913 provides software services to the Computer 902 or other components (whether illustrated or not) that are communicably coupled to the Computer 902. The functionality of the Computer 902 can be accessible for all service consumers using the Service Layer 913. Software services, such as those provided by the Service Layer 913, provide reusable, defined functionalities through a defined interface. For example, the interface can be software written in JAVA, C++, another computing language, or a combination of computing languages providing data in extensible markup language (XML) format, another format, or a combination of formats. While illustrated as an integrated component of the Computer 902, alternative implementations can illustrate the API 912 or the Service Layer 913 as stand-alone components in relation to other components of the Computer 902 or other components (whether illustrated or not) that are communicably coupled to the Computer 902. Moreover, any or all parts of the API 912 or the Service Layer 913 can be implemented as a child or a sub-module of another software module, enterprise application, or hardware module without departing from the scope of the present disclosure.

The Computer 902 includes an Interface 904. Although illustrated as a single Interface 904, two or more Interfaces 904 can be used according to particular needs, desires, or particular implementations of the Computer 902. The Interface 904 is used by the Computer 902 for communicating with another computing system (whether illustrated or not) that is communicatively linked to the Network 930 in a distributed environment. Generally, the Interface 904 is operable to communicate with the Network 930 and includes logic encoded in software, hardware, or a combination of software and hardware. More specifically, the Interface 904 can include software supporting one or more communication protocols associated with communications such that the Network 930 or hardware of Interface 904 is operable to communicate physical signals within and outside of the illustrated Computer 902.

The Computer 902 includes a Processor 905. Although illustrated as a single Processor 905, two or more Processors 905 can be used according to particular needs, desires, or particular implementations of the Computer 902. Generally, the Processor 905 executes instructions and manipulates data to perform the operations of the Computer 902 and any algorithms, methods, functions, processes, flows, and procedures as described in the present disclosure.

The Computer 902 also includes a Database 906 that can hold data for the Computer 902, another component communicatively linked to the Network 930 (whether illustrated or not), or a combination of the Computer 902 and another component. For example, Database 906 can be an in-memory, conventional, or another type of database storing data consistent with the present disclosure. In some implementations, Database 906 can be a combination of two or more different database types (for example, a hybrid in-memory and conventional database) according to particular needs, desires, or particular implementations of the Computer 902 and the described functionality. Although illustrated as a single Database 906, two or more databases of similar or differing types can be used according to particular needs, desires, or particular implementations of the Computer 902 and the described functionality. While Database 906 is illustrated as an integral component of the Computer 902, in alternative implementations, Database 906 can be external to the Computer 902.

The Computer 902 also includes a Memory 907 that can hold data for the Computer 902, another component or components communicatively linked to the Network 930 (whether illustrated or not), or a combination of the Computer 902 and another component. Memory 907 can store any data consistent with the present disclosure. In some implementations, Memory 907 can be a combination of two or more different types of memory (for example, a combination of semiconductor and magnetic storage) according to particular needs, desires, or particular implementations of the Computer 902 and the described functionality. Although illustrated as a single Memory 907, two or more Memories 907 or similar or differing types can be used according to particular needs, desires, or particular implementations of the Computer 902 and the described functionality. While Memory 907 is illustrated as an integral component of the Computer 902, in alternative implementations, Memory 907 can be external to the Computer 902.

The Application 908 is an algorithmic software engine providing functionality according to particular needs, desires, or particular implementations of the Computer 902, particularly with respect to functionality described in the present disclosure. For example, Application 908 can serve as one or more components, modules, or applications. Further, although illustrated as a single Application 908, the Application 908 can be implemented as multiple Applications 908 on the Computer 902. In addition, although illustrated as integral to the Computer 902, in alternative implementations, the Application 908 can be external to the Computer 902.

The Computer 902 can also include a Power Supply 914. The Power Supply 914 can include a rechargeable or non-rechargeable battery that can be configured to be either user- or non-user-replaceable. In some implementations, the Power Supply 914 can include power-conversion or management circuits (including recharging, standby, or another power management functionality). In some implementations, the Power Supply 914 can include a power plug to allow the Computer 902 to be plugged into a wall socket or another power source to, for example, power the Computer 902 or recharge a rechargeable battery.

There can be any number of Computers 902 associated with, or external to, a computer system containing Computer 902, each Computer 902 communicating over Network 930. Further, the term "client," "user," or other appropriate terminology can be used interchangeably, as appropriate, without departing from the scope of the present disclosure. Moreover, the present disclosure contemplates that many users can use one Computer 902, or that one user can use multiple computers 902.

In some implementations, the described methodology can be configured to send messages, instructions, or other communications to a computer-implemented controller, database, or other computer-implemented system to dynamically initiate control of, control, or cause another computer-implemented system to perform a computer-implemented or other function/operation. For example, operations based on data, operations, outputs, or interaction with a GUI can be transmitted to cause operations associated with a computer, database, network, or other computer-based system to perform storage efficiency, data retrieval, or other operations consistent with this disclosure. In another example, interacting with any illustrated GUI can automatically result in one or more instructions transmitted from the GUI to trigger requests for data, storage of data, analysis of data, or other operations consistent with this disclosure.

In some instances, transmitted instructions can result in control, operation, modification, enhancement, or other operations with respect to a tangible, real-world piece of computing or other equipment. For example, the described GUIs can send a request to slow or speed up a computer database magnetic/optical disk drive, shut down/activate a computing system, cause a network interface device to disable, throttle, or increase data bandwidth allowed across a network connection, or sound an audible/visual alarm (such as, a mechanical alarm/light emitting device) as a notification of a result, behavior, determination, or analysis with respect to a computing system(s) associated with the described methodology or interacting with the computing system(s) associated with the described methodology.

In some implementation, the output of the described methodology can be used to dynamically influence, direct, control, influence, or manage tangible, real-world equipment related to hydrocarbon production, analysis, and recovery or for other purposes consistent with this disclosure. For example, data relating to equalization of hydrocarbon reservoir pressure can be used to enhance other analytical/predictive processes. As another example, the data relating to equalization of hydrocarbon reservoir pressure can be used to open/close gas injectors and valves, activate/deactivate an alarm (such as, visual, auditory, or voice alarms), or to affect refinery or pumping operations (for example, stop, restart, accelerate, or reduce). In some implementations, the described methodology can be integrated as part of a dynamic computer-implemented control system to control, influence, or use with any hydrocarbon-related or other tangible, real-world equipment consistent with this disclosure.

Described implementations of the subject matter can include one or more features, alone or in combination.

For example, in a first implementation, a computer-implemented method for equalization of hydrocarbon reservoir pressure, comprising: executing a hydrocarbon reservoir model simulation to distribute gas among available gas injectors associated with a hydrocarbon reservoir; using the result of the executed hydrocarbon reservoir simulation, executing streamline tracing to calculate hydrocarbon flow fields; using the results of the executed hydrocarbon reservoir simulation and the executed streamline tracing, executing a reservoir pressure equalization (RPE) algorithm to distribute an amount of gas according to an injection strategy to satisfy an assigned voidage replace ratio (VRR) for each region of the hydrocarbon reservoir; performing post-processing of the results of the RPE algorithm; and using the result of the post-processing, performing gas injection in the hydrocarbon reservoir with the available gas injectors.

The foregoing and other described implementations can each, optionally, include one or more of the following features:

A first feature, combinable with any of the following features, further comprising: incrementing a selected time increment period with respect to a selected prediction period; and determining whether the end of the selected prediction period has been reached.

A second feature, combinable with any of the previous or following features, wherein the injection strategy uses determined gas injection locations to enhance hydrocarbon production in low-pressure areas of the hydrocarbon reservoir.

A third feature, combinable with any of the previous or following features, wherein the streamline tracing calculates connectivity between each available gas injector and surrounding hydrocarbon producers, how much gas is injected toward each hydrocarbon producer, and how much fluid is produced from each hydrocarbon producer due to gas injection from a specific available gas injector.

A fourth feature, combinable with any of the previous or following features, wherein the RPE algorithm calculates the distribution of an amount of remaining gas among the available gas injectors based on a difference between pressure of each region of the hydrocarbon reservoir and average pressure of the entire hydrocarbon reservoir and how much of the remaining gas to allocated to compress a gas cap for each region of the hydrocarbon reservoir.

A fifth feature, combinable with any of the previous or following features, wherein the post-processing comprises generation of a gas injection efficiency cross plot, a VRR per region plot, average pressure of the hydrocarbon reservoir per region plot, and a gas injection per region plot.

A sixth feature, combinable with any of the previous or following features, further comprising generating data from the execution of the RPE algorithm for use as input to the hydrocarbon reservoir simulation.

In a second implementation, a non-transitory, computer-readable medium storing one or more instructions executable by a computer system to perform operations for equalization of hydrocarbon reservoir pressure, comprising: executing a hydrocarbon reservoir model simulation to distribute gas among available gas injectors associated with a hydrocarbon reservoir; using the result of the executed hydrocarbon reservoir simulation, executing streamline tracing to calculate hydrocarbon flow fields; using the results of the executed hydrocarbon reservoir simulation and the executed streamline tracing, executing a reservoir pressure equalization (RPE) algorithm to distribute an amount of gas according to an injection strategy to satisfy an assigned voidage replace ratio (VRR) for each region of the hydrocarbon reservoir; performing post-processing of the results of the RPE algorithm; and using the result of the post-processing, performing gas injection in the hydrocarbon reservoir with the available gas injectors.

The foregoing and other described implementations can each, optionally, include one or more of the following features:

A first feature, combinable with any of the following features, further comprising one or more instructions to: increment a selected time increment period with respect to a selected prediction period; and determine whether the end of the selected prediction period has been reached.

A second feature, combinable with any of the previous or following features, wherein the injection strategy uses determined gas injection locations to enhance hydrocarbon production in low-pressure areas of the hydrocarbon reservoir.

A third feature, combinable with any of the previous or following features, wherein the streamline tracing calculates connectivity between each available gas injector and surrounding hydrocarbon producers, how much gas is injected toward each hydrocarbon producer, and how much fluid is produced from each hydrocarbon producer due to gas injection from a specific available gas injector.

A fourth feature, combinable with any of the previous or following features, wherein the RPE algorithm calculates the distribution of an amount of remaining gas among the available gas injectors based on a difference between pressure of each region of the hydrocarbon reservoir and average pressure of the entire hydrocarbon reservoir and how much of the remaining gas to allocated to compress a gas cap for each region of the hydrocarbon reservoir.

A fifth feature, combinable with any of the previous or following features, wherein the post-processing comprises generation of a gas injection efficiency cross plot, a VRR per region plot, average pressure of the hydrocarbon reservoir per region plot, and a gas injection per region plot.

A sixth feature, combinable with any of the previous or following features, further comprising one or more instructions to generate data from the execution of the RPE algorithm for use as input to the hydrocarbon reservoir simulation.

In a third implementation, a computer-implemented system for equalization of hydrocarbon reservoir pressure, comprising: one or more computers; and one or more computer memory devices interoperably coupled with the one or more computers and having tangible, non-transitory, machine-readable media storing one or more instructions that, when executed by the one or more computers, perform operations comprising: executing a hydrocarbon reservoir model simulation to distribute gas among available gas injectors associated with a hydrocarbon reservoir; using the result of the executed hydrocarbon reservoir simulation, executing streamline tracing to calculate hydrocarbon flow fields; using the results of the executed hydrocarbon reservoir simulation and the executed streamline tracing, executing a reservoir pressure equalization (RPE) algorithm to distribute an amount of gas according to an injection strategy to satisfy an assigned voidage replace ratio (VRR) for each region of the hydrocarbon reservoir; performing post-processing of the results of the RPE algorithm; and using the result of the post-processing, performing gas injection in the hydrocarbon reservoir with the available gas injectors.

The foregoing and other described implementations can each, optionally, include one or more of the following features:

A first feature, combinable with any of the following features, further comprising one or more operations to: increment a selected time increment period with respect to a selected prediction period; and determine whether the end of the selected prediction period has been reached.

A second feature, combinable with any of the previous or following features, wherein the injection strategy uses determined gas injection locations to enhance hydrocarbon production in low-pressure areas of the hydrocarbon reservoir.

A third feature, combinable with any of the previous or following features, wherein the streamline tracing calculates connectivity between each available gas injector and surrounding hydrocarbon producers, how much gas is injected toward each hydrocarbon producer, and how much fluid is produced from each hydrocarbon producer due to gas injection from a specific available gas injector.

A fourth feature, combinable with any of the previous or following features, wherein the RPE algorithm calculates the distribution of an amount of remaining gas among the available gas injectors based on a difference between pressure of each region of the hydrocarbon reservoir and average pressure of the entire hydrocarbon reservoir and how much of the remaining gas to allocated to compress a gas cap for each region of the hydrocarbon reservoir.

A fifth feature, combinable with any of the previous or following features, wherein the post-processing comprises generation of a gas injection efficiency cross plot, a VRR per region plot, average pressure of the hydrocarbon reservoir per region plot, and a gas injection per region plot.

A sixth feature, combinable with any of the previous or following features, further comprising one or more operations to generate data from the execution of the RPE algorithm for use as input to the hydrocarbon reservoir simulation.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs, that is, one or more modules of computer program instructions encoded on a tangible, non-transitory, computer-readable medium for execution by, or to control the operation of, a computer or computer-implemented system.

Alternatively, or additionally, the program instructions can be encoded in/on an artificially generated propagated signal, for example, a machine-generated electrical, optical, or electromagnetic signal that is generated to encode information for transmission to a receiver apparatus for execution by a computer or computer-implemented system. The computer-storage medium can be a machine-readable storage device, a machine-readable storage substrate, a random or serial access memory device, or a combination of computer-storage mediums. Configuring one or more computers means that the one or more computers have installed hardware, firmware, or software (or combinations of hardware, firmware, and software) so that when the software is executed by the one or more computers, particular computing operations are performed.

The term "real-time," "real time," "realtime," "real (fast) time (RFT)," "near(ly) real-time (NRT)," "quasi real-time," or similar terms (as understood by one of ordinary skill in the art), means that an action and a response are temporally proximate such that an individual perceives the action and the response occurring substantially simultaneously. For example, the time difference for a response to display (or for an initiation of a display) of data following the individual's action to access the data can be less than 1 millisecond (ms), less than 1 second (s), or less than 5 s. While the requested data need not be displayed (or initiated for display) instantaneously, it is displayed (or initiated for display) without any intentional delay, taking into account processing limitations of a described computing system and time required to, for example, gather, accurately measure, analyze, process, store, or transmit the data.

The terms "data processing apparatus," "computer," or "electronic computer device" (or an equivalent term as understood by one of ordinary skill in the art) refer to data processing hardware and encompass all kinds of apparatuses, devices, and machines for processing data, including by way of example, a programmable processor, a computer, or multiple processors or computers. The computer can also be, or further include special purpose logic circuitry, for example, a central processing unit (CPU), a field programmable gate array (FPGA), or an application-specific integrated circuit (ASIC). In some implementations, the computer or computer-implemented system or special purpose logic circuitry (or a combination of the computer or computer-implemented system and special purpose logic circuitry) can be hardware- or software-based (or a combination of both hardware- and software-based). The computer can optionally include code that creates an execution environment for computer programs, for example, code that constitutes processor firmware, a protocol stack, a database management system, an operating system, or a combination of execution environments. The present disclosure contemplates the use of a computer or computer-implemented system with an operating system of some type, for example LINUX, UNIX, WINDOWS, MAC OS, ANDROID, IOS, another operating system, or a combination of operating systems.

A computer program, which can also be referred to or described as a program, software, a software application, a unit, a module, a software module, a script, code, or other component can be written in any form of programming language, including compiled or interpreted languages, or declarative or procedural languages, and it can be deployed in any form, including, for example, as a stand-alone program, module, component, or subroutine, for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files, for example, files that store one or more modules, sub-programs, or portions of code. A computer program can be deployed to be executed on one computer or on multiple computers that are located at one site or distributed across multiple sites and interconnected by a communication network.

While portions of the programs illustrated in the various figures can be illustrated as individual components, such as units or modules, that implement described features and functionality using various objects, methods, or other processes, the programs can instead include a number of sub-units, sub-modules, third-party services, components, libraries, and other components, as appropriate. Conversely, the features and functionality of various components can be combined into single components, as appropriate. Thresholds used to make computational determinations can be statically, dynamically, or both statically and dynamically determined.

Described methods, processes, or logic flows represent one or more examples of functionality consistent with the present disclosure and are not intended to limit the disclosure to the described or illustrated implementations, but to be accorded the widest scope consistent with described principles and features. The described methods, processes, or logic flows can be performed by one or more programmable computers executing one or more computer programs to perform functions by operating on input data and generating output data. The methods, processes, or logic flows can also be performed by, and computers can also be implemented as, special purpose logic circuitry, for example, a CPU, an FPGA, or an ASIC.

Computers for the execution of a computer program can be based on general or special purpose microprocessors, both, or another type of CPU. Generally, a CPU will receive instructions and data from and write to a memory. The essential elements of a computer are a CPU, for performing or executing instructions, and one or more memory devices for storing instructions and data. Generally, a computer will also include, or be operatively coupled to, receive data from or transfer data to, or both, one or more mass storage devices for storing data, for example, magnetic, magneto-optical disks, or optical disks. However, a computer need not have such devices. Moreover, a computer can be embedded in another device, for example, a mobile telephone, a personal digital assistant (PDA), a mobile audio or video player, a game console, a global positioning system (GPS) receiver, or a portable memory storage device.

Non-transitory computer-readable media for storing computer program instructions and data can include all forms of permanent/non-permanent or volatile/non-volatile memory, media and memory devices, including by way of example semiconductor memory devices, for example, random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices; magnetic devices, for example, tape, cartridges, cassettes, internal/removable disks; magneto-optical disks; and optical memory devices, for example, digital versatile/video disc (DVD), compact disc (CD)-ROM, DVD+/−R, DVD-RAM, DVD-ROM, high-definition/density (HD)-DVD, and BLU-RAY/BLU-RAY DISC (BD), and other optical memory technologies.

The memory can store various objects or data, including caches, classes, frameworks, applications, modules, backup data, jobs, web pages, web page templates, data structures, database tables, repositories storing dynamic information, or other appropriate information including any parameters, variables, algorithms, instructions, rules, constraints, or references. Additionally, the memory can include other appropriate data, such as logs, policies, security or access data, or reporting files. The processor and the memory can be supplemented by, or incorporated in, special purpose logic circuitry.

To provide for interaction with a user, implementations of the subject matter described in this specification can be implemented on a computer having a display device, for example, a cathode ray tube (CRT), liquid crystal display (LCD), light emitting diode (LED), or plasma monitor, for displaying information to the user and a keyboard and a pointing device, for example, a mouse, trackball, or trackpad by which the user can provide input to the computer. Input can also be provided to the computer using a touchscreen, such as a tablet computer surface with pressure sensitivity, a multi-touch screen using capacitive or electric sensing, or another type of touchscreen. Other types of devices can be used to interact with the user. For example, feedback provided to the user can be any form of sensory feedback (such as, visual, auditory, tactile, or a combination of feedback types). Input from the user can be received in any form, including acoustic, speech, or tactile input. In addition, a computer can interact with the user by sending documents to and receiving documents from a client computing device that is used by the user (for example, by sending web pages to a web browser on a user's mobile computing device in response to requests received from the web browser).

The term "graphical user interface," or "GUI," can be used in the singular or the plural to describe one or more graphical user interfaces and each of the displays of a particular graphical user interface. Therefore, a GUI can represent any graphical user interface, including but not limited to, a web browser, a touch screen, or a command line interface (CLI) that processes information and efficiently presents the information results to the user. In general, a GUI can include a number of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server, or that includes a front-end component, for example, a client computer having a graphical user interface or a Web browser through which a user can interact with an implementation of the subject matter described in this specification, or any combination of one or more such back-end, middleware, or front-end components. The components of the system can be interconnected by any form or medium of wireline or wireless digital data communication (or a combination of data communication), for example, a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) using, for example, 802.11 a/b/g/n or 802.20 (or a combination of 802.11x and 802.20 or other protocols consistent with the present disclosure), all or a portion of the Internet, another communication network, or a combination of communication networks. The communication network can communicate with, for example, Internet Protocol (IP) packets, frame relay frames, Asynchronous Transfer Mode (ATM) cells, voice, video, data, or other information between network nodes.

The computing system can include clients and servers. A client and server are generally remote from each other and typically interact through a communication network. The relationship of client and server arises by virtue of computer programs running on the respective computers and having a client-server relationship to each other.

While this specification contains many specific implementation details, these should not be construed as limitations on the scope of any inventive concept or on the scope of what can be claimed, but rather as descriptions of features that can be specific to particular implementations of particular inventive concepts. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features can be described as acting in certain combinations and even initially claimed as such, one or more features from a claimed combination can, in some cases, be excised from the combination, and the claimed combination can be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations can be considered optional), to achieve desirable results. In certain circumstances, multitasking or parallel processing (or a combination of multitasking and parallel processing) can be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

What is claimed is:

1. A computer-implemented method for equalization of hydrocarbon reservoir pressure, comprising:

executing a hydrocarbon reservoir model simulation to distribute gas among available gas injectors associated with a hydrocarbon reservoir;

using the result of the executed hydrocarbon reservoir simulation, executing streamline tracing to calculate hydrocarbon flow fields;

using the results of the executed hydrocarbon reservoir simulation and the executed streamline tracing, executing a reservoir pressure equalization (RPE) algorithm to distribute an amount of gas according to an injection strategy to satisfy an assigned voidage replace ratio (VRR) for each region of the hydrocarbon reservoir;

performing post-processing of the results of the RPE algorithm; and using the result of the post-processing, performing gas injection in the hydrocarbon reservoir with the available gas injectors.

2. The computer-implemented method of claim 1, further comprising:

incrementing a selected time increment period with respect to a selected prediction period; and determining whether the end of the selected prediction period has been reached.

3. The computer-implemented method of claim 1, wherein the injection strategy uses determined gas injection locations to enhance hydrocarbon production in low-pressure areas of the hydrocarbon reservoir.

4. The computer-implemented method of claim 1, wherein the streamline tracing calculates connectivity between each available gas injector and surrounding hydrocarbon producers, how much gas is injected toward each hydrocarbon producer, and how much fluid is produced from each hydrocarbon producer due to gas injection from a specific available gas injector.

5. The computer-implemented method of claim 1, wherein the RPE algorithm calculates the distribution of an amount of remaining gas among the available gas injectors based on a difference between pressure of each region of the hydrocarbon reservoir and average pressure of the entire hydrocarbon reservoir and how much of the remaining gas to allocated to compress a gas cap for each region of the hydrocarbon reservoir.

6. The computer-implemented method of claim 1, wherein the post-processing comprises generation of a gas injection efficiency cross plot, a VRR per region plot, average pressure of the hydrocarbon reservoir per region plot, and a gas injection per region plot.

7. The computer-implemented method of claim 1, further comprising generating data from the execution of the RPE algorithm for use as input to the hydrocarbon reservoir simulation.

8. A non-transitory, computer-readable medium storing one or more instructions executable by a computer system to perform operations for equalization of hydrocarbon reservoir pressure, comprising:

executing a hydrocarbon reservoir model simulation to distribute gas among available gas injectors associated with a hydrocarbon reservoir;

using the result of the executed hydrocarbon reservoir simulation, executing streamline tracing to calculate hydrocarbon flow fields;

using the results of the executed hydrocarbon reservoir simulation and the executed streamline tracing, executing a reservoir pressure equalization (RPE) algorithm to distribute an amount of gas according to an injection strategy to satisfy an assigned voidage replace ratio (VRR) for each region of the hydrocarbon reservoir;

performing post-processing of the results of the RPE algorithm; and using the result of the post-processing, performing gas injection in the hydrocarbon reservoir with the available gas injectors.

9. The non-transitory, computer-readable medium of claim 8, further comprising one or more instructions to:

increment a selected time increment period with respect to a selected prediction period; and determine whether the end of the selected prediction period has been reached.

10. The non-transitory, computer-readable medium of claim 8, wherein the injection strategy uses determined gas injection locations to enhance hydrocarbon production in low-pressure areas of the hydrocarbon reservoir.

11. The non-transitory, computer-readable medium of claim 8, wherein the streamline tracing calculates connectivity between each available gas injector and surrounding hydrocarbon producers, how much gas is injected toward each hydrocarbon producer, and how much fluid is produced from each hydrocarbon producer due to gas injection from a specific available gas injector.

12. The non-transitory, computer-readable medium of claim 8, wherein the RPE algorithm calculates the distribution of an amount of remaining gas among the available gas injectors based on a difference between pressure of each region of the hydrocarbon reservoir and average pressure of the entire hydrocarbon reservoir and how much of the remaining gas to allocated to compress a gas cap for each region of the hydrocarbon reservoir.

13. The non-transitory, computer-readable medium of claim 8, wherein the post-processing comprises generation of a gas injection efficiency cross plot, a VRR per region plot, average pressure of the hydrocarbon reservoir per region plot, and a gas injection per region plot.

14. The non-transitory, computer-readable medium of claim 8, further comprising one or more instructions to generate data from the execution of the RPE algorithm for use as input to the hydrocarbon reservoir simulation.

15. A computer-implemented system for equalization of hydrocarbon reservoir pressure, comprising:

one or more computers; and one or more computer memory devices interoperably coupled with the one or more computers and having tangible, non-transitory, machine-readable media storing one or more instructions that, when executed by the one or more computers, perform operations comprising:

executing a hydrocarbon reservoir model simulation to distribute gas among available gas injectors associated with a hydrocarbon reservoir;

using the result of the executed hydrocarbon reservoir simulation, executing streamline tracing to calculate hydrocarbon flow fields;

using the results of the executed hydrocarbon reservoir simulation and the executed streamline tracing, executing a reservoir pressure equalization (RPE) algorithm to distribute an amount of gas according to an injection strategy to satisfy an assigned voidage replace ratio (VRR) for each region of the hydrocarbon reservoir;

performing post-processing of the results of the RPE algorithm; and using the result of the post-processing, performing gas injection in the hydrocarbon reservoir with the available gas injectors.

16. The computer-implemented system of claim 15, further comprising one or more operations to:

increment a selected time increment period with respect to a selected prediction period; and determine whether the end of the selected prediction period has been reached.

17. The computer-implemented system of claim 15, wherein the injection strategy uses determined gas injection locations to enhance hydrocarbon production in low-pressure areas of the hydrocarbon reservoir.

18. The computer-implemented system of claim 15, wherein the streamline tracing calculates connectivity between each available gas injector and surrounding hydrocarbon producers, how much gas is injected toward each hydrocarbon producer, and how much fluid is produced from each hydrocarbon producer due to gas injection from a specific available gas injector.

19. The computer-implemented system of claim 15, wherein the RPE algorithm calculates the distribution of an amount of remaining gas among the available gas injectors based on a difference between pressure of each region of the hydrocarbon reservoir and average pressure of the entire hydrocarbon reservoir and how much of the remaining gas to allocated to compress a gas cap for each region of the hydrocarbon reservoir.

20. The computer-implemented system of claim 15, further comprising one or more operations to generate data from the execution of the RPE algorithm for use as input to the hydrocarbon reservoir simulation.

* * * * *